US007431599B2

(12) United States Patent
Luzzi

(10) Patent No.: US 7,431,599 B2
(45) **Date of Patent: *Oct. 7, 2008**

(54) SHRINKABLE MULTIPLE BORE CONNECTION SYSTEM

(75) Inventor: Glenn J. Luzzi, Mt. Bethel, PA (US)

(73) Assignee: Richards Manufacturing Company, Irvington, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/292,758

(22) Filed: Dec. 2, 2005

(65) Prior Publication Data

US 2006/0084307 A1 Apr. 20, 2006

Related U.S. Application Data

(63) Continuation of application No. 10/824,151, filed on Apr. 13, 2004, now Pat. No. 6,991,484.

(51) Int. Cl.
*H01R 13/53* (2006.01)

(52) U.S. Cl. ..... 439/181; 439/89; 174/74 A

(58) Field of Classification Search ..... 439/181, 439/89; 174/74 A
See application file for complete search history.

(56) References Cited

U.S. PATENT DOCUMENTS 3,515,798 A 6/1970 Sievert
3,824,331 A 7/1974 Mixon, Jr. et al.
3,980,374 A * 9/1976 Fallot ..... 439/89
3,993,387 A 11/1976 Venezia
4,070,746 A 1/1978 Evan et al.
5,421,750 A 6/1995 Crotty
5,922,423 A 7/1999 Jeremko
6,103,975 A * 8/2000 Krabs et al. ..... 174/74 A
6,189,575 B1 2/2001 Ions et al.
6,230,746 B1 5/2001 Ions et al.
6,337,440 B1 1/2002 Ions et al.
6,811,418 B2 * 11/2004 Jazowski et al. ..... 439/181

* cited by examiner

*Primary Examiner*—Truc T Nguyen
(74) *Attorney, Agent, or Firm*—Stroock & Stroock & Lavan LLP

(57) ABSTRACT

The present invention relates to a cable termination system for connection of a cylindrical member, such as a cable, within a housing containing multiple bores. One or more bores of the housing are held in a radially expanded state by one or more retaining devices. The cable may be coupled to a coupling device, such as a metallic lug, and inserted into a first bore such that a connection is made with a first mating device inserted into a second bore. Additionally, a second mating device may be inserted into a third bore to finalize the connection. After the connection is completed, each retaining device is de-coupled from its respective bore causing the housing surrounding the bore to contract to its original state, thereby forming a tight seal between the housing and the cable or mating device.

25 Claims, 13 Drawing Sheets

SHRINKABLE MULTIPLE BORE CONNECTION SYSTEM

CROSS-REFERENCE TO RELATED APPLICATIONS

This application is a continuation application of U.S. patent application Ser. No. 10/824,151, filed Apr. 13, 2004, titled SHRINKABLE MULTIPLE BORE CONNECTION SYSTEM now U.S. Pat. No. 6,991,484.

TECHNICAL FIELD OF THE INVENTION

The present invention relates to a shrinkable, multiple bore connection system that may be used for terminating electrical cables. More particularly, the present invention relates to a shrinkable, multiple bore termination system for connecting an electrical cable to an apparatus, such as a transformer or high voltage switch, where the cable is coupled to a coupling device, such as a metallic lug, having a larger outside diameter than the cable. The invention is ideally suited for use with electrical cables and/or electrical equipment, but may be used to connect other cylindrical members and apparatus.

BACKGROUND OF THE INVENTION

Existing cable connection systems and termination systems for connecting a cable to an apparatus are known in the art. A termination system typically includes, at a minimum, a cable or wire, an apparatus, a metallic lug (i.e., a connector typically having a bore in one end for insertion of a cable and an aperture at the opposite end for connection to an apparatus bushing), a stud (i.e., a pin type or threaded device inserted into the aperture of the metallic lug), mating devices (i.e., devices that couple to the stud to maintain the stud within the aperture of the metallic lug) and a housing (i.e., a device that encloses the cable/apparatus connection and forms a tight seal with the outside of the metallic lug, cable shield, insulation, and jacket to prevent contamination or corrosion of the connection).

According to a commonly known termination system, an end of the cable is prepared, prior to termination, by stripping, peeling back or removing all layers surrounding the internal conductive element of the cable including the cable jacket, insulation, shielding, etc., such that the cable conductor is exposed. The cable conductor is then inserted into the bore of a metallic lug, which is crimped (i.e., pressure is applied to the exterior of the metallic lug bore until the cable conductor cannot be easily removed). Thereafter, the metallic lug is inserted into a bore entrance of a housing, sometimes via an interference fit (discussed in greater detail below), such that the end of the metallic lug containing the aperture enters the housing first.

Next, a stud is connected to a first mating device utilizing one of various methods known in the art. Alternatively, the stud may be permanently affixed to the first mating device. Typically, the first mating device is a component affixed to the apparatus (e.g., transformer, high voltage switch, etc.) to be coupled to the cable. A second bore entrance of the housing is then placed over the stud such that the stud penetrates the metallic lug aperture. A second mating device is then inserted into a third bore entrance and coupled to the stud such that a conductive physical connection is created between the metallic lug and the first mating device. The connection of the metallic lug, stud, and mating devices may incorporate additional components and may be performed in alternate configurations utilizing a variety of methods that are known in the art.

Depending on certain criteria, such as the amperage rating of the cable, a metallic lug may be required that has a larger outside diameter than the cable. For example, a 200 ampere connector system is able to use a metallic lug having a smaller outside diameter than the cable. However, a 600 ampere connector system must use a metallic lug having a larger outside diameter than the cable. The 600-ampere metallic lug is larger for a number of reasons, including high momentary current and the need to bolt the 600-ampere metallic lug to the mating device. In addition to its larger diameter, the lug and lug interface is typically longer than that used by the 200 ampere connector system, therefore the 600 ampere connector system requires a longer housing which is more difficult to assemble. Consequently, a connector system that works well for a 200 ampere cable may not be used to terminate a 600 ampere cable unless a cable adapter is provided to adapt the outside diameter of the cable to a diameter larger than the outside diameter of the metallic lug. Unfortunately, the addition of a cable adapter adds time and complexity to the installation of the termination, derates the termination's ampacity (i.e., the termination must be rated at a lower current than the cable on which it is installed), introduces an additional point of potential failure, and requires choosing the correct cable adapter from a range of cable adapter sizes. Therefore, it would be desirable to use a 200 ampere-type termination system to perform a 600-ampere termination without the need to utilize a cable adapter.

Many types of 200 ampere connector systems are in use today. Interference fit tubular connector systems have existed in the prior art for 200 ampere cables for over thirty-five years. Typically, an end of the cable is prepared and the resulting exposed cable conductor is inserted into a metallic lug, an end of which is then crimped to the cable. Thereafter, the metallic lug is inserted into one end of a tubular housing. The inside diameter of the tubular housing is designed to be smaller than the outside diameter of the cable, but larger than the outside diameter of the metallic lug. Therefore, the metallic lug slides easily into the tubular housing. However, the cable must be forced into the tubular housing, causing an interference fit (i.e., insertion of the cable stretches the elastomeric material of the tubular housing such that the tubular housing elastically grips the cable insulation, shield, and jacket creating a secure contact that does not allow moisture, dirt, and/or water to penetrate the seal between the cable and the tubular housing). Whereas interference fit tubular connector systems are commonly used for 200 ampere connections, they are not suitable for 600 ampere systems. This is because the outside diameter of the metallic lug is larger than the outside diameter of the cable, and the metallic lug is longer in length, therefore requiring a longer housing.

Shrinkable tubular connector systems are also commonly used for 200 ampere terminations, since they do not require the relatively high assembly forces required by interference fit connector systems. In lieu of forcing a cable into a housing, a shrinkable connector system incorporates a housing with an inside diameter that is radially expanded to a diameter larger than its intended final diameter, which, similar to the interference fit, is smaller than the outside diameter of the cable to be terminated. Since the inside diameter of the tubular housing is radially expanded, the cable and metallic lug can be easily inserted into the tubular housing without the application of force. When the components are in the proper position, the tubular housing is released from its radially expanded state, or shrunk, to the intended final inside diameter, thereby creating a tight seal with the cable. Many methods of shrinking a housing are known in the art including removal of a retaining member (i.e., a physical device located internal or external to the housing that physically holds the inside diameter of the housing in its radially expanded state) and application of heat, pressure, or chemicals. Conventional shrinkable tubular connector systems are popular, easy to install, and work well with 200 ampere straight connector systems and other connector systems having non-critical geometries. However, they are not suitable for 600 ampere cable terminations due to the different interface and critical geometry associated with a 600 ampere elbow connector system.

For example, a conventional internal retaining member is a core used to radially expand the housing, which is used only with tubular connector systems, such as the 200 ampere straight connector systems. Tubular, straight connector systems can accommodate the core because it allows the core to extend through and out of either end of the connector system. Cores, however, have a flaw. The ends of the core cannot withstand excessive pressure, such as the pressure of the expanded housing, and will collapse if such pressure is applied. Therefore, the core must be longer than the connector system, wherein the ends of the core are external to the housing, at a sufficient distance, ensure that they are not subjected to undue pressure. Accordingly, the expanded housing is usually centered in the middle of the core. In order for the housing to be centered in the middle of the core and permit the ends of the core to extend a sufficient distance outside of the housing, it is necessary for the housing to be tubular. If the core is inserted into a non-tubular connector system, such as a 600 ampere connector system, one end of the core must be within the housing of the connector system. Because of the pressure of the housing, the end of the core within the housing would likely collapse, resulting in the entire core collapsing. External cores encounter similar problems. Therefore, internal and external cores are typically not used with non-tubular connector systems.

As stated above, a typical 600 ampere connector system uses a cable adapter that has one diameter that forms a tight seal with the cable insulation and shield and another diameter that forms a tight seal with the interior of the housing. Although the cable adapter creates many problems, as discussed below, the cable adapter is required because the outside diameter of the metallic lug is larger than the inside diameter of the tubular housing and cannot be easily "pushed" into the tubular housing. If the metallic lug is allowed to touch the inside of the housing, physical damage or contamination of the interior of the tubular housing may occur, both of which could result in an electrical failure of the connector system. In contrast, if the inside diameter of the tubular housing is increased to prevent interference to the outside diameter of the metallic lug, the tubular housing would no longer be able to form a tight seal with the smaller diameter of the cable.

Although the cable adapter allows 600 ampere cables to be connected utilizing the aforementioned housings, the installation of the cable adapter creates many problems. First, for example, choosing the correct cable adapter for the cable insulation diameter size from a range of sizes, the complexity and time required to complete the connection is increased due to the installation of the additional cable adapter component. Second, the cable adapter and its associated two interference fit connections (i.e., connecting the cable to the cable adapter and connecting the cable adapter to the housing) introduce an additional potential point of failure to the resulting cable connection. Third, performing the two interference fit connections associated with the cable adapter increases the amount of labor required to terminate the cable. Fourth, the cable adapter derates the resulting cable connection by creating an air gap between the metallic lug and the housing that acts to thermally insulate the cable. Finally, the cable adapter further derates the system by encircling the cable insulation thereby adding additional thermal insulation to the cable. The magnitude of the combined derating of the termination is such that, in practice, cable systems designed for 1000 amperes may be required to operate at a maximum of 600 amperes.

In order to provide a better understanding of the state of the art related to the field of electrical connector systems, discussed below are several references. Although these references serve to provide a perspective as to the state of the related art, they fail to disclose the novel aspects of the present invention as discussed in detail herein.

For example, U.S. Pat. No. 3,515,798 to Sievert ("Sievert") discloses a shrinkable, tubular, connector system for performing straight or other non-critical geometry connections using a metallic lug with an outside diameter smaller than the cable. The tubular housing is held in a radially expanded state by a tubular core comprised of a single strip wound helically and welded together such that a tubular core having a consistent inner and outer diameter is formed. After the installer connects the cable, metallic lug, and mating device and inserts the resulting assembly into the housing, the installer pulls the end of the single strip away from the tubular housing causing the tubular core to separate along the helical grooves. When the helical grooves separate, the core loses its tubular configuration and no longer holds the tubular housing in its radially expanded state. The housing thereby shrinks, encircling the cable, metallic lug, and mating device, and creating a tight seal with the cable.

Similar to Sievert, U.S. Pat. No. 3,824,331 to Mixon, Jr. et al. ("Mixon") also discloses a shrinkable tubular connector system for performing straight or other non-critical geometry connections using a metallic lug with an outside diameter smaller than the cable. Mixon also discloses a core that is located external to the tubular housing. The ends of the tubular housing are rolled backwards onto the external core such that the core holds the rolled portions of the tubular member in position. After the installer connects the cable, metallic lug, and mating device and inserts the resulting assembly into the housing, the installer unrolls the ends of the tubular housing onto the protruding cable. As the ends are unrolled, the tubular housing contracts forming a tight seal with the cable. When the ends are completely unrolled, the external core is removed.

U.S. Pat. No. 6,189,575 to Ions et al. ("the Ions '57 patent") discloses a recoverable article that may be used as a housing in a shrinkable connector system for performing straight or other noncritical geometry connections using a metallic lug with an outside diameter smaller than the cable. The recoverable article, or housing, comprises an inner member having a plurality of cavities. A holdout structure, similar to the previously discussed cores, holds the tubular housing in a radially expanded state by occupying the cavities on the interior of the tubular housing. After the installer connects the cable, metallic lug, and mating device and inserts the resulting assembly into the housing, the installer releases an initiating member of the holdout structure causing the tubular housing to contract and form a seal with the cable.

U.S. Pat. No. 6,230,746 to Ions et al. ("the Ions '746 patent") discloses a recoverable article similar to that disclosed in the Ions '575 patent. However, the recoverable article of the Ions '746 patent comprises an inner member having a plurality of channels, not cavities. Therefore, the holdout structure holds the tubular housing in a radially expanded state by occupying the channels on the interior of the tubular housing. After the installer connects the cable, metallic lug, and mating device and inserts the resulting assembly into the tubular housing, the installer pulls the holdout structure from the housing as a single piece causing the tubular housing to contract and form a seal with the cable.

Similar to the Ions '746 patent, U.S. Pat. No. 6,337,440 to Ions et al. ("the Ions '440 patent") also discloses a recoverable article having an inner member having a plurality of channels. However, whereas the holdout device disclosed in the Ions '746 patent is physically removed, the holdout device disclosed in the Ions '440 patent is mechanically weakened. Therefore, when the installer connects the cable, metallic lug, and mating device and inserts the resulting assembly into the housing, the installer activates the mechanical weakening of the holdout structure causing the tubular housing to contract and form a seal with the cable.

U.S. Pat. No. 5,922,423 to Jeremko ("Jeremko") also discloses a shrinkable tubular connector system for performing straight or other non-critical geometry connections using a metallic lug with an outside diameter smaller than the cable. More specifically, Jeremko discloses a molded polymeric core located internal to the tubular housing that holds the tubular housing in a radially expanded state. When the tubular housing is ready for shrinking, a tensioning element located at one end of the core is manually manipulated to facilitate removal of the core. According to Jeremko, disclosed is a core that is lighter, less expensive, and easier to manufacture than the cores in use prior to Jeremko.

U.S. Pat. No. 4,070,746 to Evans et al. ("Evans") discloses a chemically shrinkable tubular connector system for performing straight or other non-critical geometry connections using a metallic lug with an outside diameter smaller than the cable whereby an outer rigid core holds the tubular housing in a radially expanded state. When the installer is ready to shrink the tubular housing, chemical solvents are applied to the outer rigid core destroying its adhesion to the tubular housing. The rigid outer sleeve may then be peeled or broken from the tubular housing, causing the housing to shrink and form a tight seal with the cable.

In contrast to the previously discussed shrinkable tubular connector systems, U.S. Pat. No. 5,421,750 to Crotty ("Crotty") discloses an interference fit elbow connector system. The system disclosed in Crotty is specifically designed for 200 ampere cables and for terminating a first cable to a selectively removable second cable. A first cable coupled to a metallic lug having an aperture at its end is inserted utilizing an interference fit into one of the three bore entrances of the elbow housing. A second cable coupled to a stud is inserted into a second bore entrance such that the stud engages the aperture of the metallic lug. A threaded connector is then inserted into the third bore entrance and engaged with the stud and rotated until a tight electrical connection is formed between the three components.

U.S. Pat. No. 3,993,387 to Venezia ("Venezia") discloses a cable connector system that minimizes derating of the termination utilizing two different methods. First, Venezia discloses filling the air gaps between the metallic lug and the housing with an internal shield located around the cable. Second, Venezia discloses a rounded design for both the internal shield and the housing to eliminate any remaining electrical stress resulting from an improper fit between the internal shield and the housing.

Finally, U.S. Pat. No. 3,980,374 to Fallot ("Fallot") discloses an interference fit connector system comprising two bores affixed at the center of each bore such that the two bores are perpendicular to each other resulting in four bore entrances. The system is specifically designed to connect two 600 ampere primary distribution system cables. The housing receives two cables on opposing ends of one bore. A cable adapter and two interference fits are used for each cable (i.e., to connect the cable to the cable adapter and to connect the cable adapter to the housing).

Cable termination systems that terminate a cable coupled to a metallic lug of a larger diameter than the cable are known in the art. However, these cable termination systems all require the use of a cable adapter to adapt the outside diameter of the cable to a diameter larger than the outside diameter of the metallic lug. The cable adapter creates many problems including additional complexity and time to complete the installation, introduction of an additional point of failure, higher installation forces, derating of the resulting cable termination, and higher cost.

Furthermore, the majority of these systems require the use of a sealing jacket to seal the system housing to the terminated cable. However, the use of a sealing jacket that is separate from the housing introduces an additional point of potential failure of the termination, additional area subject to water or soil penetration, increased installation time and unnecessary installation complexity.

In light of the prior art discussed herein, it is desirable to provide a simple, easy to install, shrinkable cable connector system using a housing having two or more bores and a metallic lug with a larger outside diameter than the cable that does not require a cable adapter, the large installation forces necessary for installation of the cable adapter, or a separate sealing jacket.

SUMMARY OF THE INVENTION

The present invention relates to a novel cable connector system for terminating a cable to an apparatus, such as a transformer or high voltage switch, within a housing. The present invention is a simple, economical system that terminates a cable that is connected to a coupling device, such as a metallic lug having a larger outside diameter than the cable to which it is attached, to an apparatus.

The present invention provides a system that is easier to install, less expensive, more reliable, and rated for higher amperage than the cable termination systems known in the art. Whereas the systems commonly known in the art utilize a cable adapter, multiple interference fits, and a separate sealing jacket, an embodiment of the present invention provides a simplified system eliminating the need for the cable adapter, multiple interference fits and the separate sealing jacket. The present invention can comprise an elbow housing with a shrinkable bore entrance that forms a tight seal between the housing and the cable insulation, cable shield, cable jacket, and the metallic lug of the termination system without the need for a cable adapter or a separate sealing jacket.

A primary distinction between the present invention and shrinkable housings known in the art is that prior art housings are typically cylindrical with the entire housing being radially expanded and contracted. These housings are used to terminate cables in a non-critical geometry connection, such as a straight connection, to an apparatus. In contrast, an embodiment of the present invention incorporates a non-cylindrical housing (i.e., elbow shaped), with only a portion being radially expanded and contracted. The housing can be used for critical geometry connections to an apparatus, such as an elbow or "T" connection, and for sealing the cable insulation shield and jacket of the prepared cable end.

An embodiment of the termination system of the present invention comprises an elastomeric elbow housing containing three tubular bore entrances. The housing comprises three layers of material including an interior conductive insert layer that surrounds the metallic lug, an intermediate nonconductive insulating layer, and an outer conductive jacket. In a preferred embodiment, the housing is first molded to its non-expanded dimensions. Thereafter, one of the tubular bore entrances is radially expanded to a diameter larger than its intended final diameter and is held in its radially expanded state by a retainer member, such as a rigid core. A variety of rigid cores can be used, including an extruded nylon cord wound to a specific inside and outside diameter and welded along the inner diameter such that the core maintains its tubular shape. Alternatively, a spirally perforated core or a solid core covered with a thin plastic film having a low coefficient of friction may be used. Other common cores, as well as those not yet contemplated, may be used with the present invention without departing from the spirit of the invention.

Additionally, although the embodiment described includes one radially expanded bore, alternative embodiments may include multiple radially expanded bores.

The present invention can preferably overcome the significantly high forces present at the terminus of the non-expanded portion of the housing and the expanded portion of the housing. These forces are of such magnitude that they would crush the end of a typical cylindrical rigid core commonly used in a straight termination. The present invention may incorporate a few different methods to help prevent the significantly high forces from crushing the rigid core. First, a rigid core having thick walls can be used. Second, a rigid core having a thick wall only at one end can be used. Third, and preferred, a separate ring can be placed at the end of the rigid core that is inserted into the housing. This ring can either remain in the housing or may be removed prior to insertion of the cable.

According to an embodiment of the present invention, a cable is prepared and connected to a metallic lug containing an aperture at the end opposite to which the cable is inserted utilizing common techniques known in the art. The metallic lug is then inserted into the radially expanded bore entrance of the elbow housing such that the end of the metallic lug containing the aperture enters first and the aperture is positioned perpendicular to the other two bore entrances of the elbow housing. A stud is then inserted or screwed into a first mating device, which is typically affixed to the apparatus, if the device does not already have a permanently connected stud. A second bore entrance of the elbow housing is then inserted over the first mating device, such that the stud slides into the metallic lug aperture, so that half of the stud protrudes from the opposite side of the aperture.

Thereafter, a second mating device is inserted through the third, unused bore entrance and is threaded onto the stud until a specified torque is attained. As described below, the rigid core is then removed allowing the bore to contract and substantially encase the metallic lug, thereby substantially removing the air surrounding the metallic lug. Additionally, a nonconductive portion of the interior of the bore contracts to encase a portion of the cable insulation, insulation shield, metallic shield and jacket.

In the preferred embodiment of the present invention, the rigid core comprises a nylon cord. After inserting the metallic lug, one end of the nylon cord is pulled causing the welding that holds the nylon cord in a tubular configuration to break apart beginning at the end farthest from the cable and proceeding laterally to the end closest to the cable. As each section of the nylon cord unravels, the tubular core breaks down and the surrounding elastomeric housing contracts to its original diameter thereby forming a tight seal between the elbow housing and the cable jacket, insulation, and shield. Next, the end of the housing is folded over the cable's metallic shield and jacket, which was previously coated with a sealant, such as a flexible synthetic polymer sealant (e.g., butyl mastic sealant), thereby creating a waterproof seal without the need for a separate sealing jacket. Finally, a wire is inserted through an aperture in the elbow housing, twisted such that the wire is affixed to the housing, and connected to ground (i.e., an electrically conductive body that maintains a zero potential—it is not positively or negatively charged).

Traditional termination systems that utilize a metallic lug having a larger diameter than the cable incorporate a cable adapter to adjust the diameter of the cable to a diameter slightly larger than the diameter of the metallic lug, as well as a separate sealing means (i.e., a heat shrinkable sleeve, a cold shrinkable sleeve, tape, etc.) to seal the termination. Although utilization of a cable adapter and a separate sealing means is currently standard practice in the art, the cable adapter creates many problems including additional complexity and time to complete the installation, introduction of an additional point of failure, higher installation forces, and derating of the resulting cable termination. Similarly, the use of a sealing means separate from the housing introduces additional area subject to water penetration, causes longer installation time, and adds unnecessary complexity to the installation. However, the present invention incorporates an integral jacket seal, which eliminates the need for a separate sealing means, and allows a metallic lug having a larger diameter than the cable to be terminated to be used without the need for a cable adapter, thereby eliminating all of the aforementioned problems.

Thus, it is an object of the present invention to provide a method and apparatus for terminating a cable coupled to a metallic lug having a larger diameter than the cable that eliminates the utilization of a cable adapter.

Also, it is an object of the present invention to provide a method and apparatus for terminating a cable coupled to a metallic lug having a larger diameter than the cable that eliminates the utilization of a sealing means that is separate from the housing of the termination system.

Further, it is an object of the present invention to provide a method and apparatus for terminating a cable coupled to a metallic lug having a larger diameter than the cable that eliminates the utilization of a cable adapter while still utilizing commonly known and practiced termination techniques.

Moreover, it is an object of the present invention to provide a method and apparatus for terminating a cable coupled to a metallic lug having a larger diameter than the cable, eliminating the utilization of a cable adapter while still providing an airtight and watertight seal between the termination system housing and the cable insulation, shield, and jacket.

It is a further object of the present invention to provide a method and apparatus for terminating a cable coupled to a metallic lug having a larger diameter than the cable that minimizes air gaps between the metallic lug and the termination system housing.

Furthermore, it is an object of the present invention to provide a method and apparatus for terminating a cable coupled to a metallic lug having a larger diameter than the cable that is easier to install and requires lower installation forces than the known methods and apparatus.

In addition, it is an object of the present invention to provide a method and apparatus for terminating a cable coupled to a metallic lug having a larger diameter than the cable that accomplishes some or all of the aforementioned objectives without redesigning conventional metallic lugs or cables and without modifying conventional connection or termination practices.

Other objects, features, and characteristics of the present invention, as well as the methods of operation and functions of the related elements of the structure, and the combination of parts and economies of manufacture, will become more apparent upon consideration of the following detailed description with reference to the accompanying drawings, all of which form a part of this specification.

BRIEF DESCRIPTION OF THE DRAWINGS

A further understanding of the present invention can be obtained by reference to a preferred embodiment set forth in the illustrations of the accompanying drawings. Although the illustrated embodiment is merely exemplary of systems for carrying out the present invention, both the organization and method of operation of the invention, in general, together with further objectives and advantages thereof, may be more easily understood by reference to the drawings and the following description. The drawings are not intended to limit the scope of this invention, which is set forth with particularity in the claims as appended or as subsequently amended, but merely to clarify and exemplify the invention.

For a more complete understanding of the present invention, reference is now made to the following drawings in which.

DETAILED DESCRIPTION OF A PREFERRED EMBODIMENT

Figure 1A:
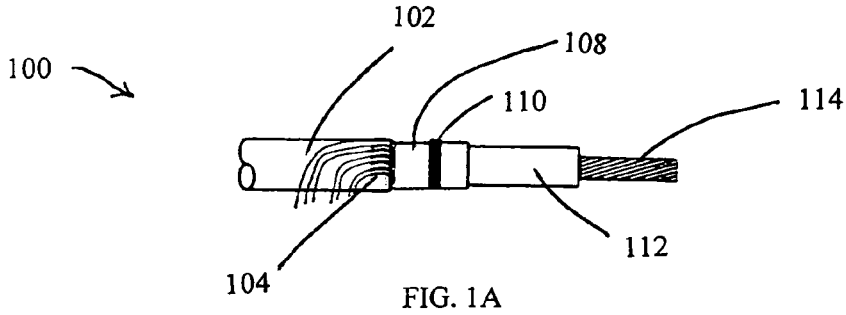
FIG. 1A depicts a prepared cable end for use with a prior art 600-ampere termination system.

As required, a detailed illustrative embodiment of the present invention is disclosed herein. However, techniques, systems and operating structures in accordance with the present invention may be embodied in a wide variety of forms and modes, some of which may be quite different from those in the disclosed embodiment. Consequently, the specific structural and functional details disclosed herein are merely representative, yet in that regard, they are deemed to afford the best embodiment for purposes of disclosure and to provide a basis for the claims herein which define the scope of the present invention. The following presents a detailed description of a preferred embodiment of the present invention.

Referring initially to FIGS. 1A-1F, shown is a typical prepared cable end 100 for a prior art 600-ampere housing termination system. As depicted, prepared cable end 100 comprises an outer cable jacket 102, shield wires 104, extruded insulation shield 108, tape marker 110, cable insulation 112, and cable conductor 114. To create prepared cable end 100 according to conventional systems, outer cable jacket 102 is removed and shield wires 104 are folded back from insulation shield 108 and folded over outer cable jacket 102 as shown. Extruded insulation shield 108 is also removed to partially expose cable insulation 112. Cable insulation 112 is removed to expose cable conductor 114, and tape marker 110 is installed to a specified dimension or location. Prepared cable end 100 is then wiped clean from the end of cable conductor 114 to shield wires 104. Prepared cable end 100 is now prepared for termination.

Figure 1B:
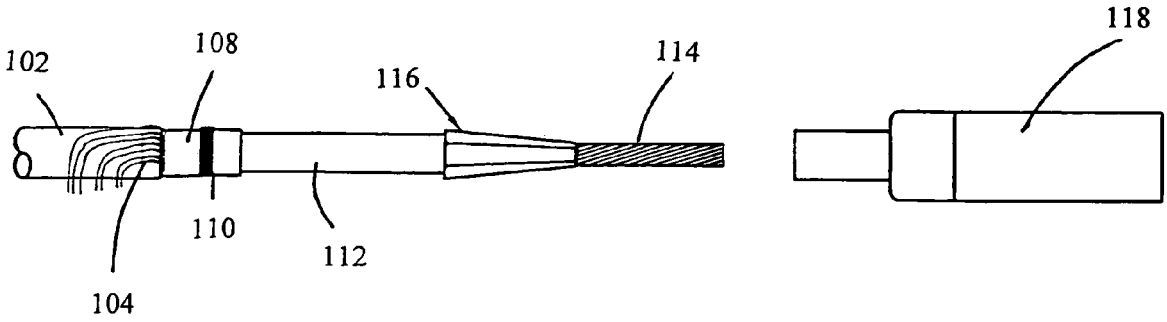
FIG. 1B depicts the prepared cable end of FIG. 1A with an assembly aid and a detached cable adapter for a prior art 600-ampere termination system.
Figure 1C:
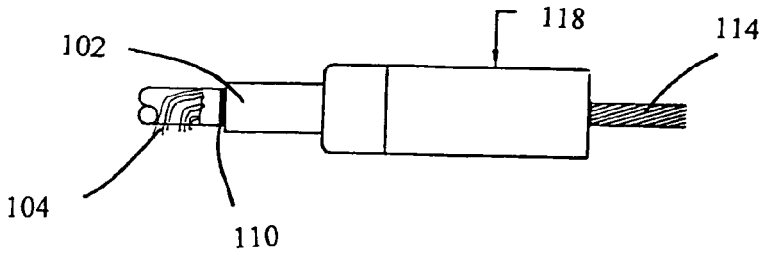
FIG. 1C depicts the prepared cable end of FIG. 1A inserted into a cable adapter for a prior art 600 ampere termination system.

Turning to FIG. 1B, shown is prepared cable end 100 having assembly aid 116 (an optional component) drawn over prepared cable end 100 such that assembly aid 116 touches cable insulation 112. Thereafter, lubricant is applied to cable insulation 112, assembly aid 116, and the interior of a detached cable adapter 118 to facilitate installation of cable adapter 118 onto cable insulation 112. Referring to FIG. 1C, the assemblage of FIG. 1B is shown after cable adapter 118 is forced onto prepared cable end 100 until cable adapter 118 makes contact with tape marker 110 creating an interference fit with cable insulation 112 and extruded insulation shield 108. After installation of cable adapter 118, a sufficient amount of cable conductor 114 (e.g., approximately 5 inches) protrudes from cable adapter 118. Thereafter, assembly aid 116, if used, may be removed.

Figure 1D:
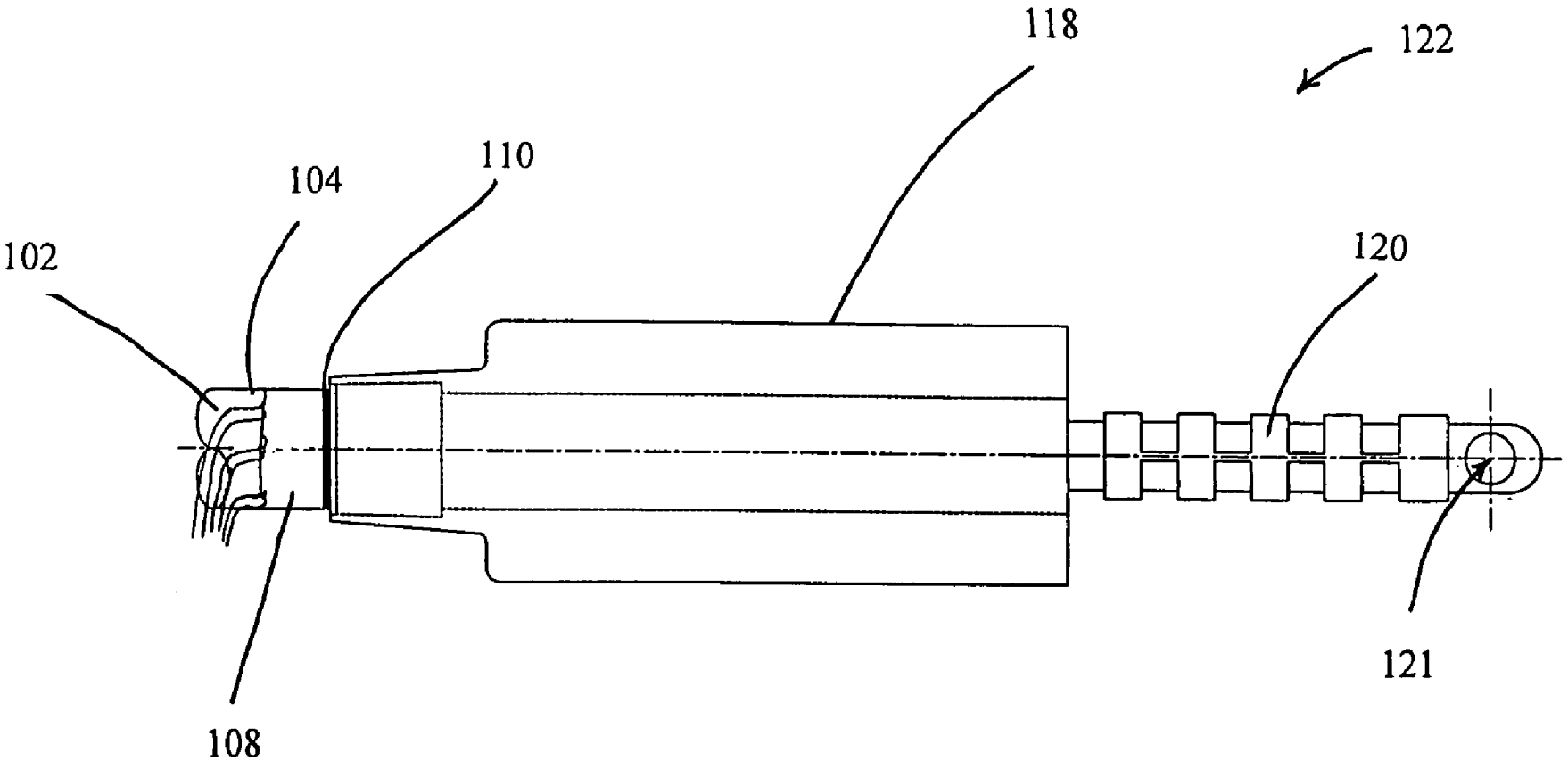
FIG. 1D depicts the assemblage of FIG. 1C with the cable end coupled to a metallic lug for a prior art 600-ampere termination system, wherein the dotted lines depict the cable insulation within the cable adapter.

Referring next to FIG. 1D, the left side of metallic lug 120 is inserted over the protruding cable conductor 114. Once metallic lug 120 is properly positioned, metallic lug 120 is crimped to cable conductor 114 utilizing a crimping tool and/or one of various methods known in the art. Metallic lug 120 includes an aperture 121 located at the end of metallic lug 120 that is opposite to cable adapter 118.

Figure 1E:
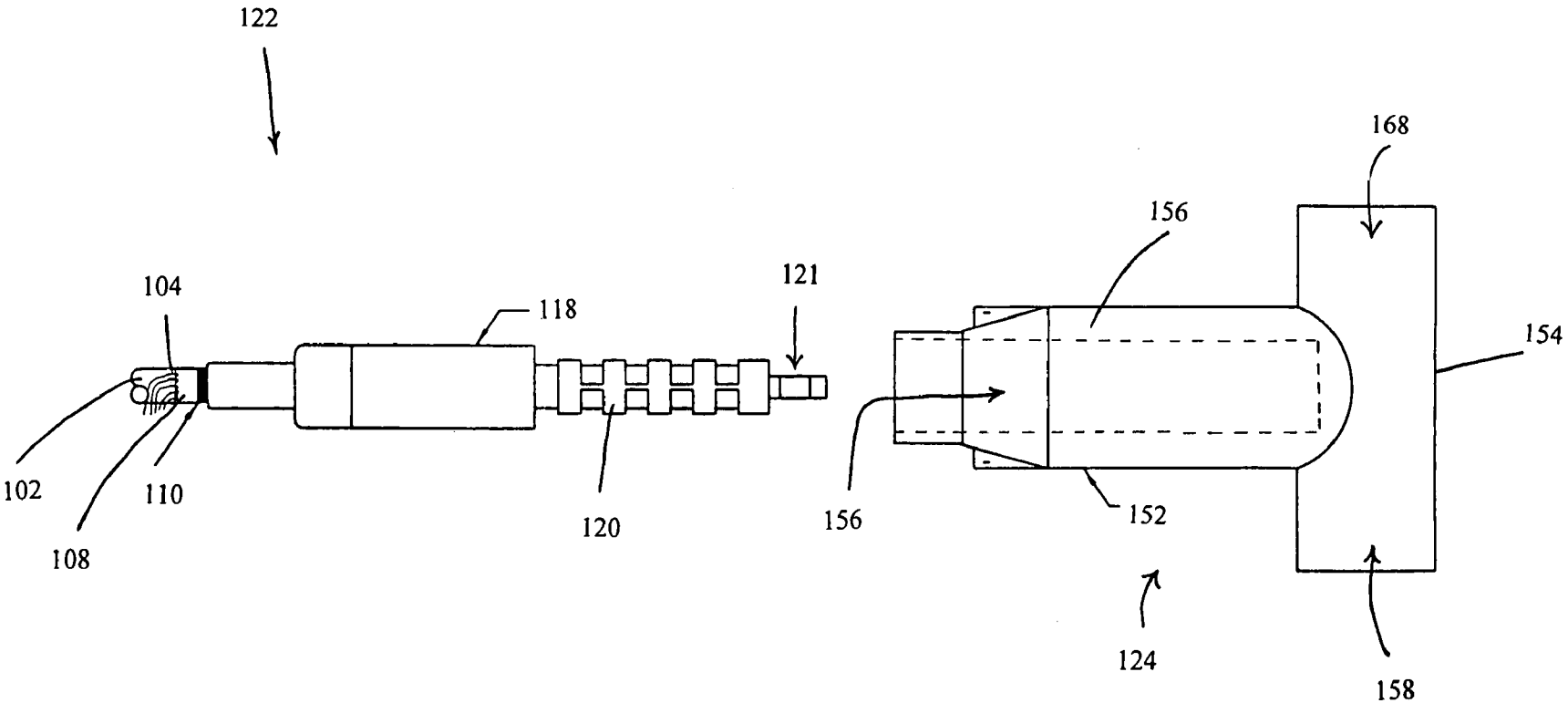
FIG. 1E depicts the assembly shown in FIG. 1D oriented for insertion into a detached housing for a prior art 600-ampere termination system.

Housing 124 is forced over assembly 122 of FIG. 1D as depicted in FIG. 1E. As shown in FIG. 1E, housing 124 generally comprises two legs 152 and 154, which are perpendicular to each other. Leg 152 comprises tubular bore 156 and leg 154 comprises a first tapered bore 158 and a second tapered bore 168. As depicted by the dashed lines in FIG. 1E, tubular bore 156 of leg 152 begins at the end opposite leg 154 and extends almost through leg 152 to the point where tubular bore 156 intersects with leg 154. As depicted in FIG. 1E, first tapered bore 158 is located at the bottom end of leg 154 and second tapered bore 168 is located at the top end of leg 154. Housing 124 typically comprises an elastomeric material that allows assembly 122 to be inserted into leg 152 to create an interference fit. Prior to insertion, lubricant is applied to the exterior of cable adapter 118 and the interior of tubular bore 156. Assembly 122 is then inserted into tubular bore 156 and positioned such that aperture 121 of metallic lug is perpendicular to first tapered bore 158 and second tapered bore 168, creating an interference fit between cable adapter 118 and housing 124. Tape marker 110 may then be removed.

Figure 1F:
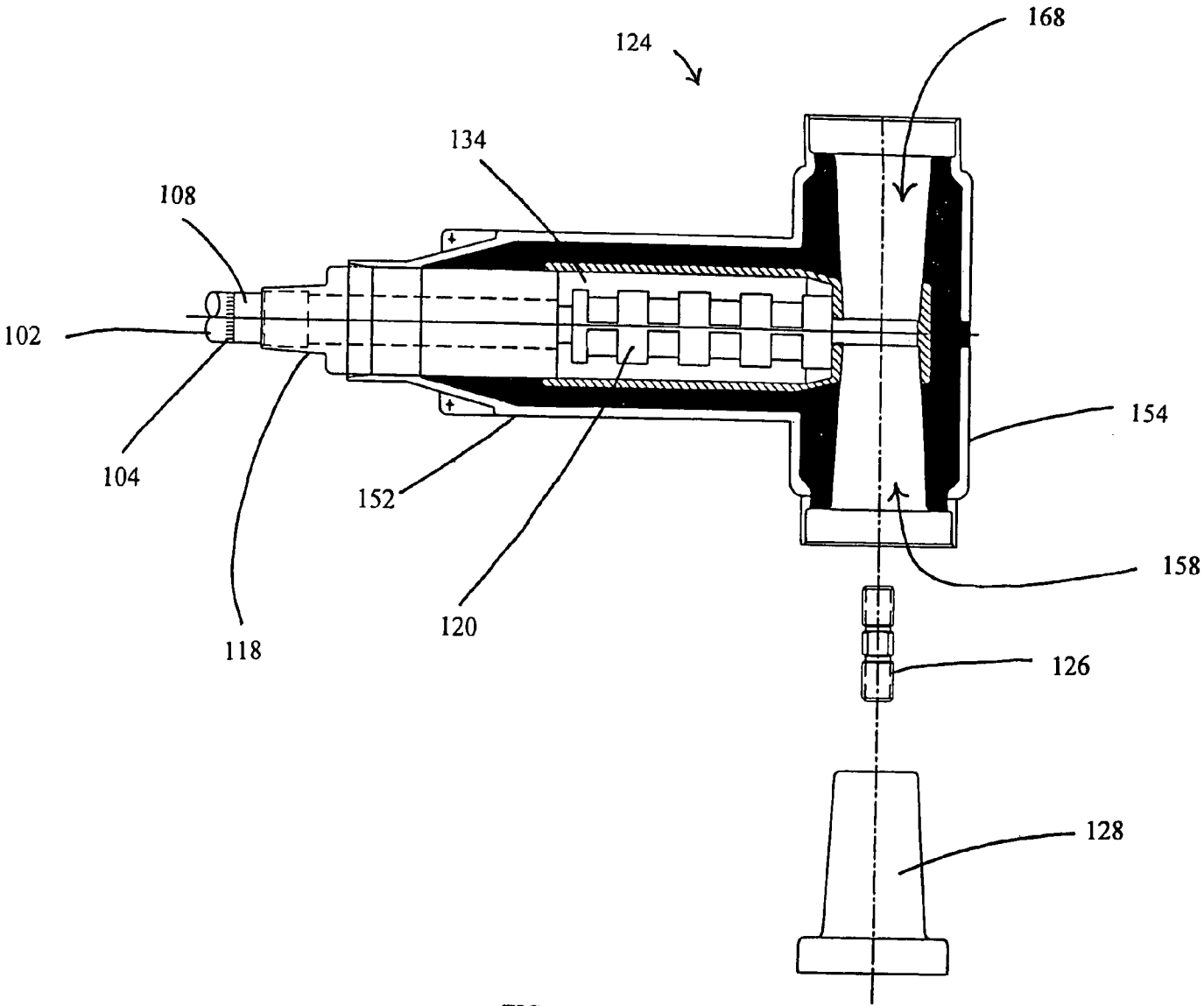
FIG. 1F is a cross sectional view of the assembly shown in FIG. 1E, a detached second mating device, and a detached stud for a prior art 600 ampere termination system.
Figure 1G:
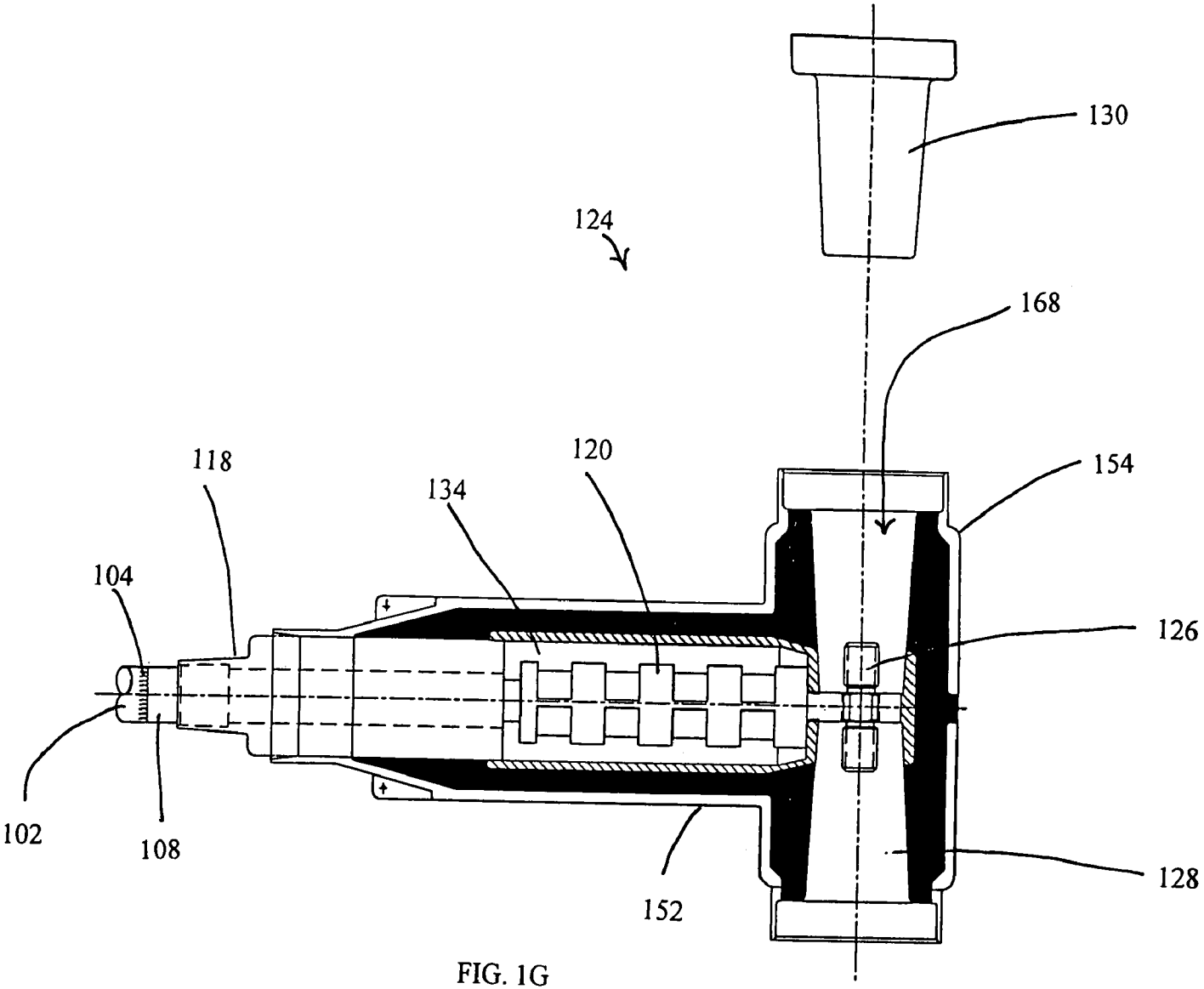
FIG. 1G is a cross sectional view of the assembly shown in FIG. 1E, a detached second mating device, and an attached stud for a prior art 600 ampere termination system.

FIG. 1F shows assembly 122 after it has been inserted into housing 124, along with detached stud 126 and detached first mating device 128. To complete the termination, stud 126 is inserted into first mating device 128 and rotated, typically by hand, until tightly connected to first mating device 128 if first mating device 128 is not already equipped with a permanently affixed stud 126. Stud 126, first mating device 128, and the interior of housing 124 are then cleaned and a lubricant is applied. First tapered bore 158 of housing 124 is then placed over first mating device 128 such that stud 126 is positioned in aperture 121 of metallic lug 120. Then, as shown in FIG. 1G, detached second mating device 130 is cleaned, lubricated, and inserted into second tapered bore 168 of housing 124. After-insertion, second mating device 130 is rotated or threaded onto stud 126 until a specified torque is attained. The threading of second mating device 130 to stud 126 creates a proper electrical connection between first mating device 128 and prepared cable end 100 coupled to metallic lug 120.

Also, as depicted in FIGS. 1F and 1G, a common problem with the prior art is that an air gap 134 exists both between cable adapter 118 and cable conductor 114 and between metallic lug 120 and the inside diameter of tubular bore 156. These air gaps 134 thermally insulate metallic lug 120 and cable conductor 114, which create thermal resistance that derates the resulting cable termination. Moreover, because cable adapter 118 overlaps cable insulation 112 as shown in FIG. 1C, cable adapter 118 adds additional thermal insulation to cable insulation 112, also creating thermal resistance that further derates the resulting cable termination. The derating of the cable termination caused by the combined thermal resistance is of such a magnitude that in practice, a cable rated for 1000 amperes must be operated at no more than 600 amperes, which unnecessarily increases the cost of the cable termination when higher amperage operation is required.

According to a preferred embodiment of the present invention, as depicted in FIGS. 2-6, cable adapter 118 is eliminated. Consequently, the associated thermal resistance and derating of the termination, the additional potential point of failure, high installation forces, additional time, and added complexity associated with cable adapter 118 are minimized or eliminated entirely. In addition, the need for a separate sealing jacket is substantially eliminated. Specifically, the present invention can provide a watertight and airtight seal between the housing and both the prepared cable end and the metallic lug such that air gap 134 is substantially eliminated, and cable adapter 118 and a separate sealing jacket are no longer essential.

Figure 2:
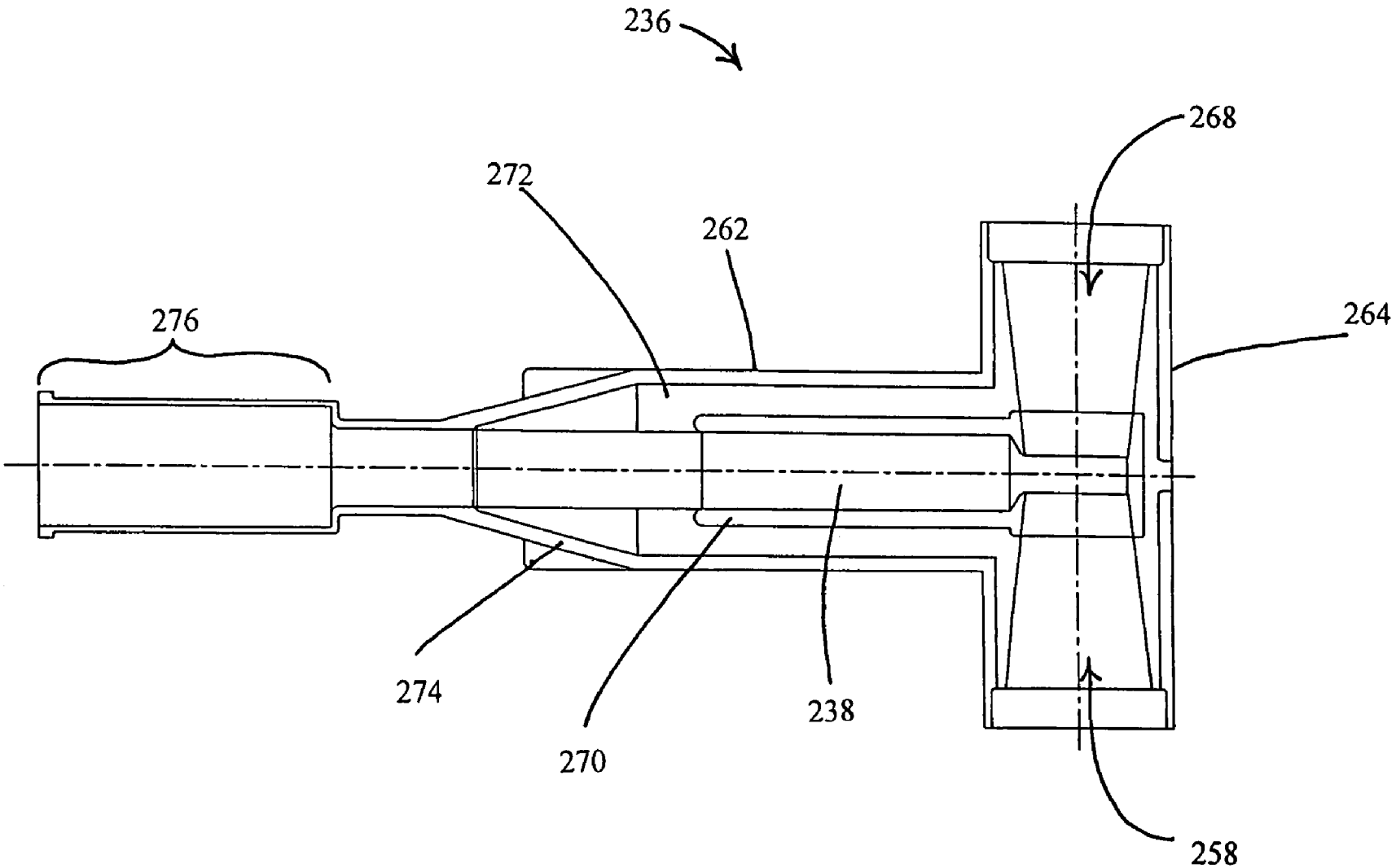
FIG. 2 is a cross-sectional view of an elbow housing incorporating a preferred termination system according to the present invention, showing a non-expanded bore.
Figure 3:
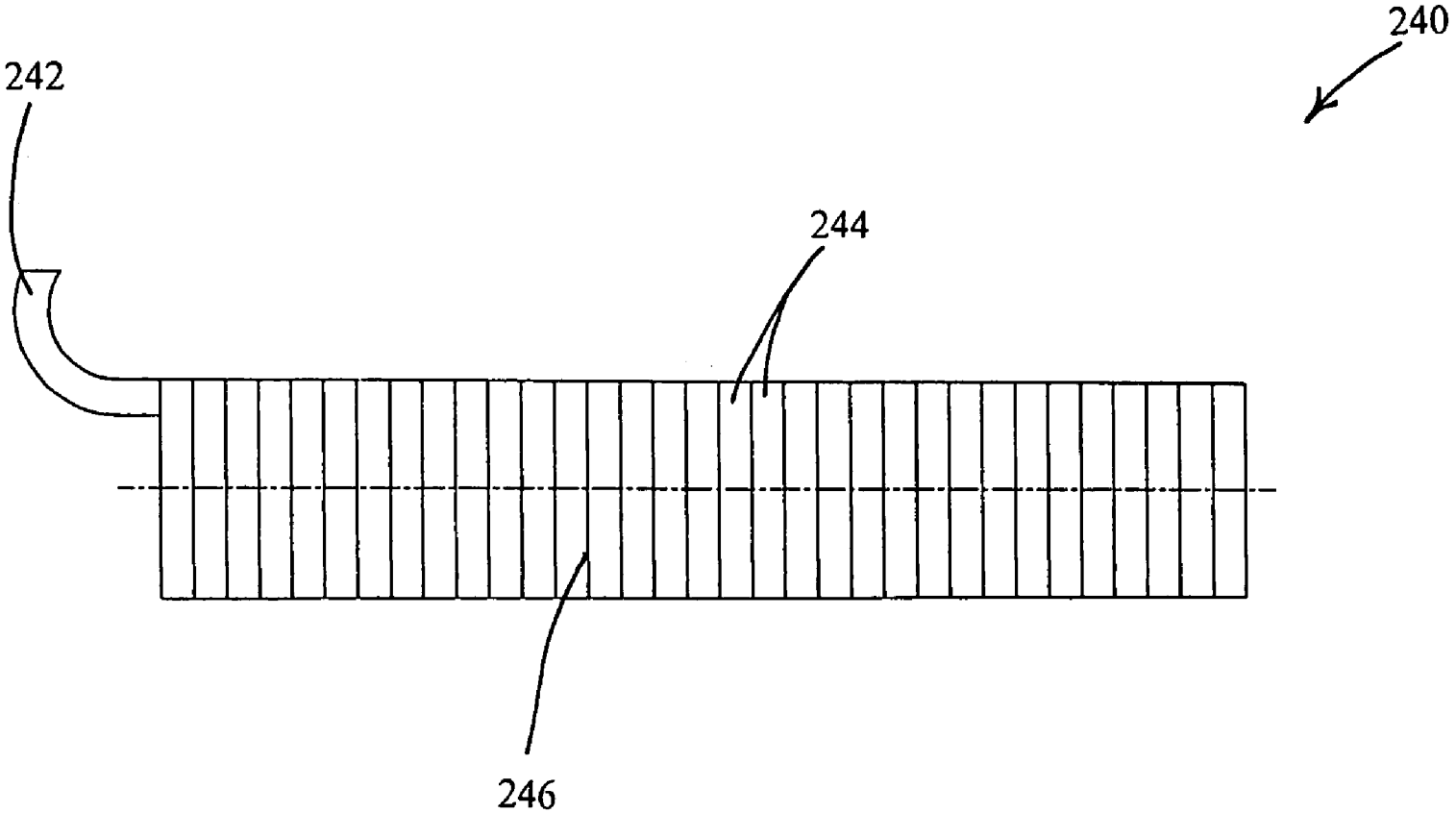
FIG. 3 is a side view of a support core for use with a preferred termination system according to the present invention.
Figure 4:
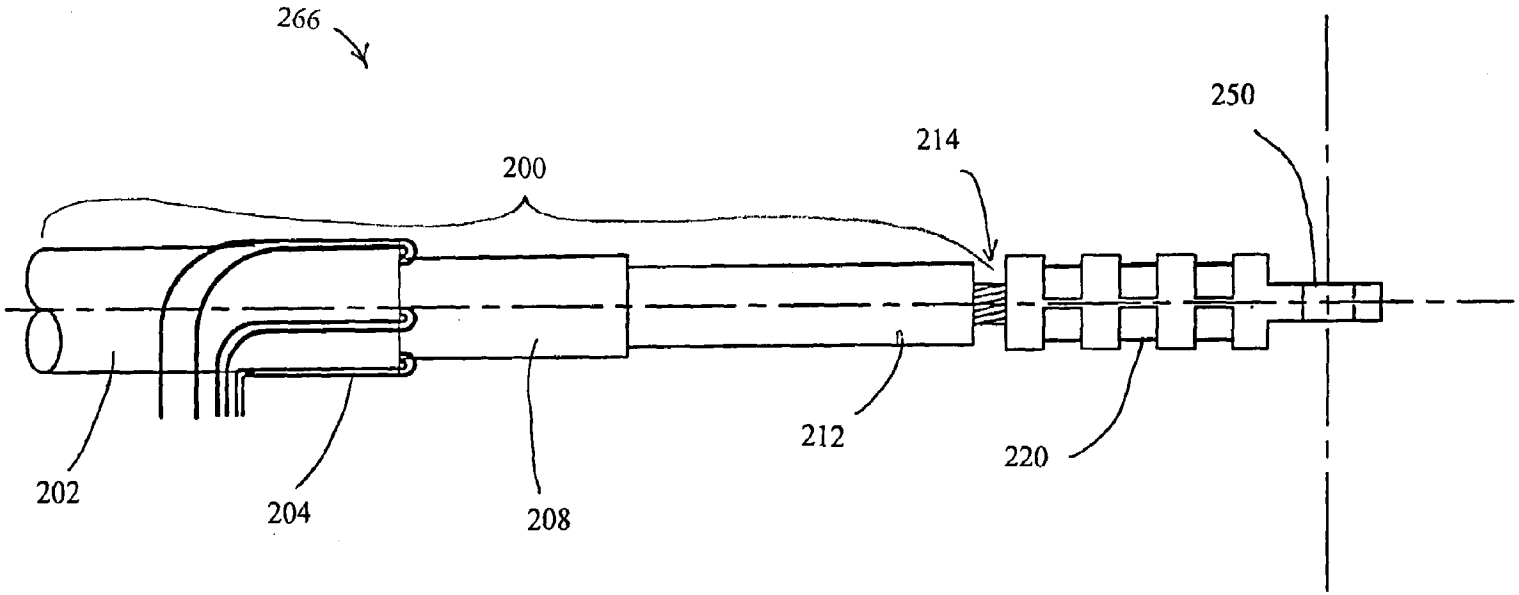
FIG. 4 is a side view of a prepared cable end coupled to a metallic lug for use with a preferred termination system of the present invention.

Referring next to FIG. 2, an embodiment of housing 236 for use in accordance with the termination system of the present invention is shown. Preferably, housing 236 comprises two legs 262 and 264, which are perpendicular to each other. Leg 262 comprises tubular bore 238 and leg 264 contains first tapered bore 258 and second tapered bore 268. As illustrated in FIG. 2, tubular bore 238 of leg 262 begins at the end opposite leg 264 and extends towards leg 264. First tapered bore 258 is located at the bottom end of leg 264 and second tapered bore 268 is located at the top end of leg 264. FIGS. 2 and 3 show tubular bore 238 and support core 240, respectively, independent of each other. FIG. 2 shows tubular bore 238 in its relaxed or non-expanded state. As shown in FIG. 4, a cable assembly 266 that can be used with the present invention comprises prepared cable end 200 coupled to metallic lug 220 without a cable adapter.

Figure 5:
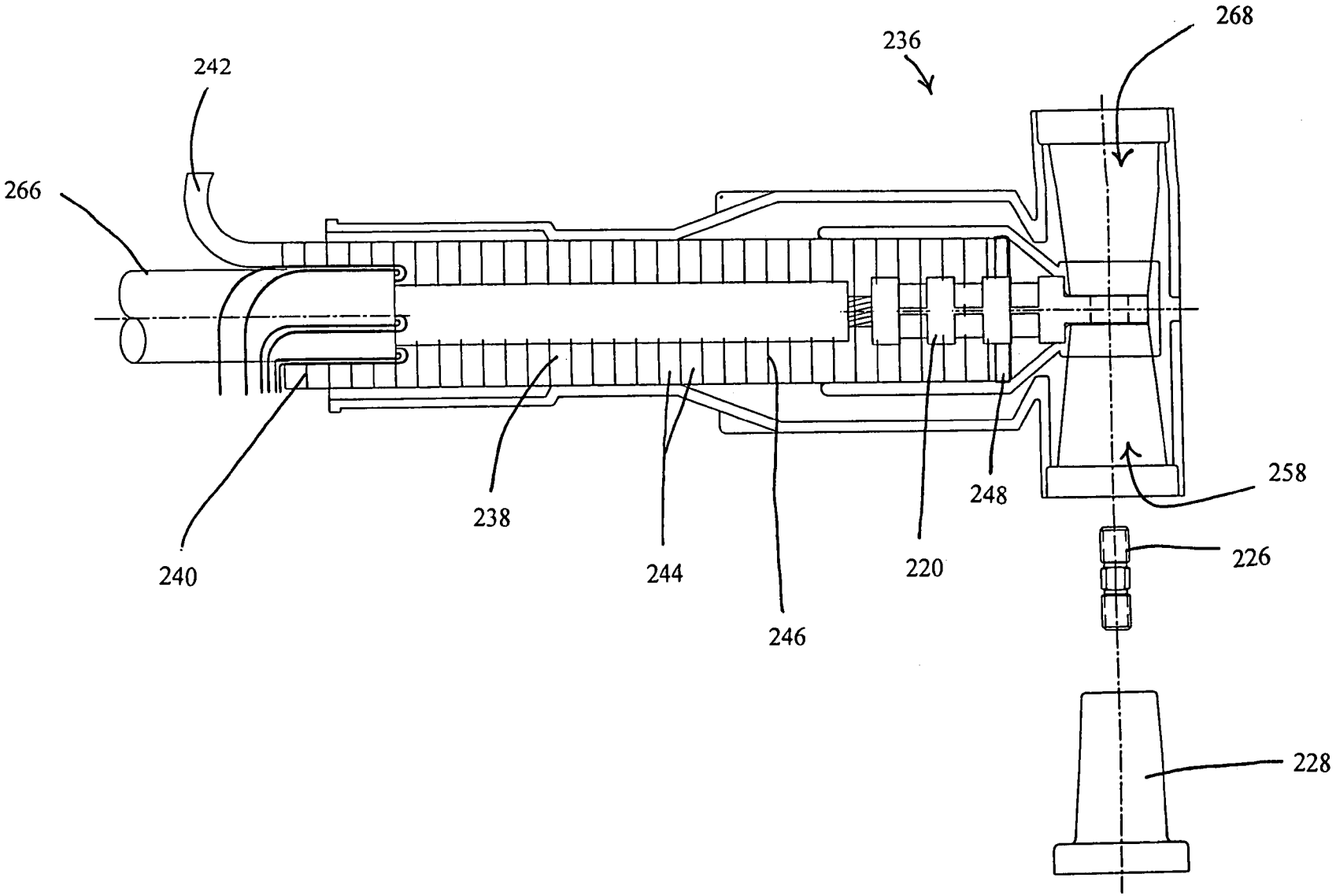
FIG. 5 is a cross sectional view of an elbow housing incorporating a preferred termination system according to the present invention, showing a radially expanded bore held in its expanded state via a support core and a support ring with the assembly shown in FIG. 4 inserted into the elbow housing of FIG. 2.
Figure 6:
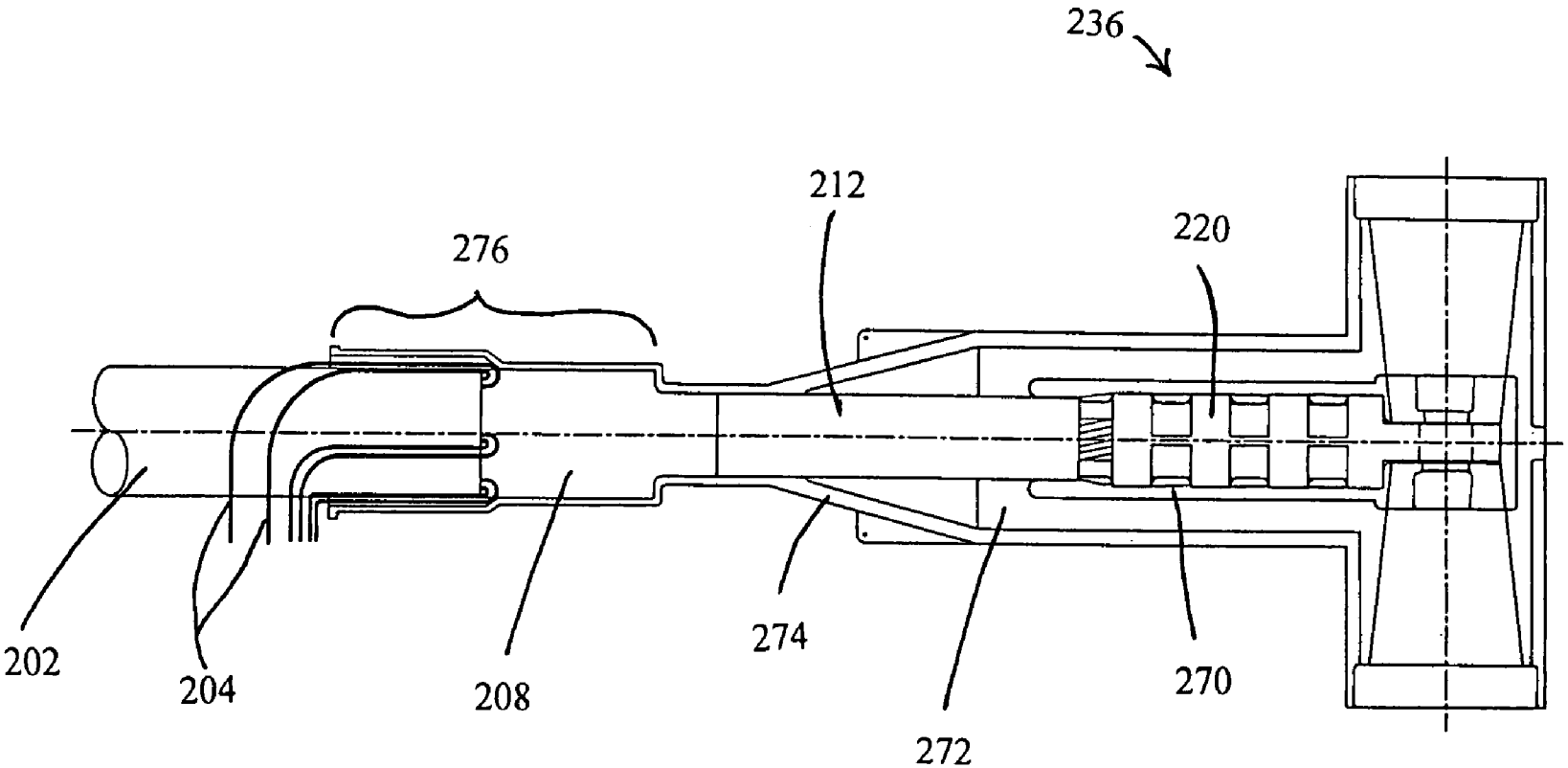
FIG. 6 is a cross-sectional view of a preferred embodiment of the termination system according to the present invention, including the assembly shown in FIG. 4 with the second mating device inserted into the elbow housing, after the rigid core is removed from the elbow housing and one bore entrance of the elbow housing is in its contracted state to provide a lateral seal around the prepared cable.

In FIG. 5, tubular bore 238 is shown in its expanded state, via support core 240, which holds tubular bore 238 in its radially expanded state. As shown in FIGS. 2, 5 and 6, in the embodiment, housing 236 is molded to form three layers of three different types of a highly elastic rubber material that has a low permanent-set (i.e., when the material is stretched or expanded, it will recover to nearly its original size), such as Ethylene Propylene Diene Monomer ("EPDM"). Specifically, housing 236 includes an interior conductive insert layer 270, an intermediate nonconductive insulating layer 272, and an outer conductive jacket 274. The conductive properties of layers 236 and 274 can be varied by altering the amount or type of material, such as carbon, included in the EPDM mixture. Furthermore, sealing jacket portion 276 of housing 236 may be comprised from yet a fourth EPDM or non-EPDM material as a matter of application specific design choice.

Housing 236 can also comprise other materials having the same or similar low permanent-set characteristic, such as silicone. Alternatively, housing 236 may be fabricated from a material having a lower permanent-set characteristic than EPDM. Such materials are typically less desirable due to other shortcomings, such as cost and water vapor transmission. Additionally, housing 236 may comprise a hybrid of components that are comprised of a variety of materials such as an EPDM/silicone mixture.

As shown in FIG. 3, an embodiment of support core 240 preferably comprises a nylon or polypropylene cord wound in a tubular configuration or a perforated nylon/polypropylene tube having a uniform inside and outside diameter thereby creating multiple adjacent coils 244. These adjacent coils 244 are welded together at interfaces 246 to maintain the tubular configuration of support core 240. Although adjacent coils 244 are preferably welded together at interfaces 246, adjacent coils 244 may still be separated along interfaces 246 which contain indentations, perforations, or some other means of separation. However, in a welded state, support core 240 has enough rigidity to hold tubular bore 238 in a radially expanded state.

Referring to FIGS. 3 and 5, support core 240 is preferably an extruded nylon or polypropylene tube of 0.125" to 0.250" thickness that is cut helically but not to the extent that such helical cut completely separates the tube. However, a support core having an alternate thickness or material may be employed in accordance with the present invention. For example, support core 240 may comprise fiberglass reinforced plastic to improve its strength, especially at the ends, which, as discussed earlier, are too weak to withstand the pressure of the expanded housing 236. This may resolve the problem with internal cores due to the weak ends and prevent unintentional collapse of housing 236.

To remove support core 240 from tubular bore 238, thereby releasing tubular bore 238 from its radially expanded state, support core 240 can be unraveled by pulling end 242 such that adjacent coils 244 are separated along interfaces 246. Preferably, support core 240 is wound such that pulling end 242 causes the tubular configuration of support core 240 to unravel beginning at the end furthest inside of tubular bore 238 (i.e., nearest to the end of tubular bore 238 adjacent to first tapered bore 258 and second tapered bore 268) and finishing at the end nearest the opening of tubular bore 238. Support core 240 is unraveled in this manner to prevent the exterior end from prematurely collapsing and obstructing the removal of support core 240.

It is envisioned, though, that one may configure support core 240 such that an end used to begin the unraveling thereof may be extended through first tapered bore 258 or second tapered bore 268 and pulled therefrom such that support core 240 begins to unravel from its end nearest the opening of tubular bore 238 and finishes at the end nearest first tapered bore 258 and second tapered bore 268. It is also envisioned that support core 240 does not comprise an end used to begin the unraveling process. Rather, another initiating means can be used.

In an alternate embodiment, support core 240 may comprise more than one layer of coils 244. In other words, support core 240 may have an additional layer of coils concentrically placed within or around coils 244 or it may be a single cord cut in a way that allows two layers of coils that can both be unraveled with one pull. As a consequence, the strength of support core 240 is increased.

Alternatively, a secondary support may be used to strengthen support core 240. For example, a reinforcement structure can be placed within the tubular bore to provide additional support to maintain housing 236 in its expanded state. The reinforcement structure may extend through the entire length of support core 240 or be present only at one end, preferably at the end of support core 240 furthest inside tubular bore 238, as a matter of application specific to design choice. The reinforcement structure may provide additional support to the entire support core 240 or only at one end, as long as it helps maintain housing 236 in its expanded state and helps prevent it from collapsing unintentionally. The reinforcement structure can be inserted into tubular bore 238 before, simultaneously with or after support core 240, as a matter of application specific to design choice. Preferably, cable end 200 is inserted into tubular bore 238 and metallic lug 220 engages first and second tapered bores 258, 268 prior to removal of the reinforcement structure. Once metallic lug 220 is in place, the reinforcement structure may be removed (or collapsed and left inside bore 238 if it is totally contained within conductive insert 270), thus initiating the removal of support core 240 and therefore the collapse of housing 236.

One embodiment of the reinforcement structure that can be used with the invention is a collapsible structure 248, as shown in FIG. 5, which is removable through first or second tapered bores 258, 268 or bore 238, or collapsed and left inside bore 238 if it is totally contained within the conductive insert 270. Collapsible structure 248 can be placed proximate the end of support core 240 furthest inside tubular bore 238. Collapsible structure 248 can be designed to withstand radial force but not lateral force. Therefore collapsible structure 248 would not collapse when it is within expanded housing 236 but will collapse when it is tugged at in a lateral direction consistent with tubular bore 238. Collapsible structure 248 may comprise a pulling member extending through either first tapered bore 258 or second tapered bored 268. Once cable end 200 is inserted into tubular bore 238 and metallic lug 220 engages first and second tapered bores 258, 268, the pulling member can be pulled. This will apply a lateral force on collapsible structure 248, causing it to collapse. Preferably, collapsible structure 248 is designed to fit through first or second tapered bore 258, 268 or bore 238 to ensure complete removal of the collapsible structure. In an alternate preferred embodiment of collapsible structure 248, it can be collapsed and left inside bore 238 if it is totally contained within conductive insert 270. When collapsible structure 248 collapses, it no longer supports the end of support core 240 furthest inside tubular bore 238, causing it to also collapse, thereby initiating the collapse and removal of support core 240 and thus the collapse of housing 236.

Another embodiment of the support core can be a solid core 340 that is slid out of tubular bore 238 in order to release tubular bore 238 from its radially expanded state. Preferably, the solid core is generally tubular in shape and comprises nylon, polyvinylchloride or polycarbonate. The tubular wall is preferably thick enough to ensure that tubular bore 238 is sufficiently supported while providing diameter wide enough to permit relatively easy passage of assembly 122.

Figure 7:
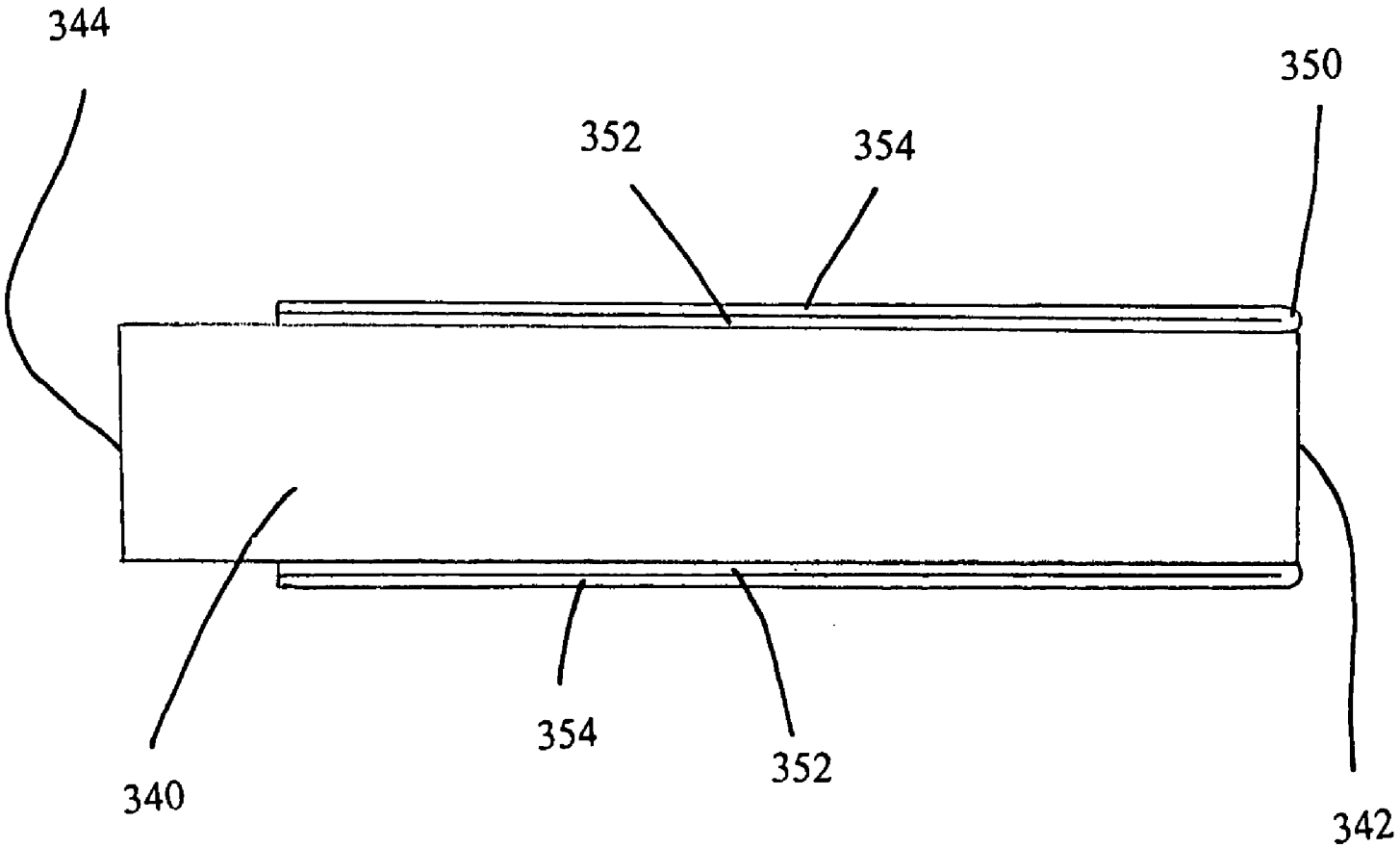
FIG. 7 is a cross-sectional view of a support core for use with a preferred termination system according to the present invention.
Figure 8:
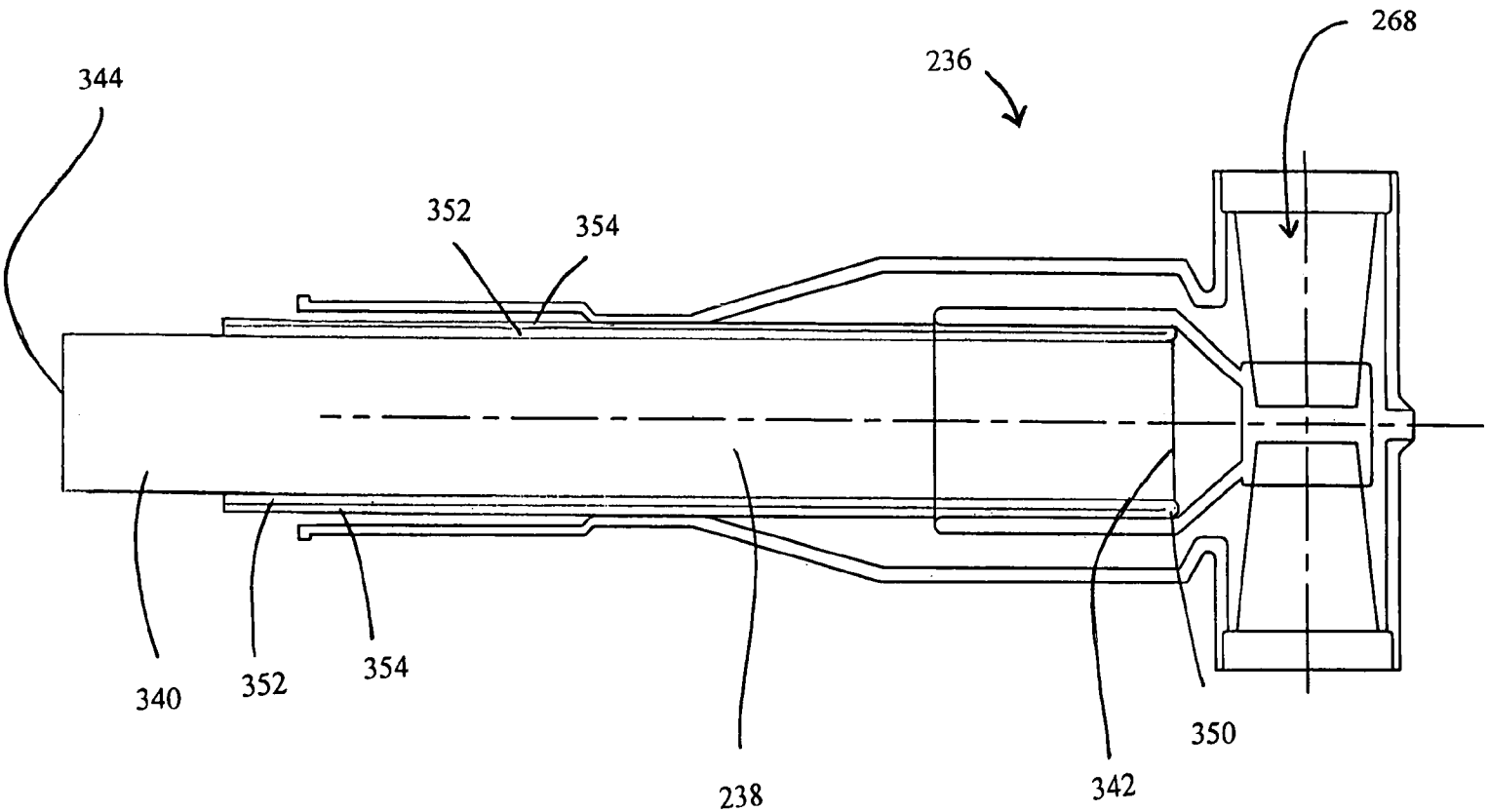
FIG. 8 is a cross sectional view of an elbow housing incorporating a preferred termination system according to the present invention, showing a radially expanded bore held in its expanded state via the support core of FIG. 7.
Figure 9:
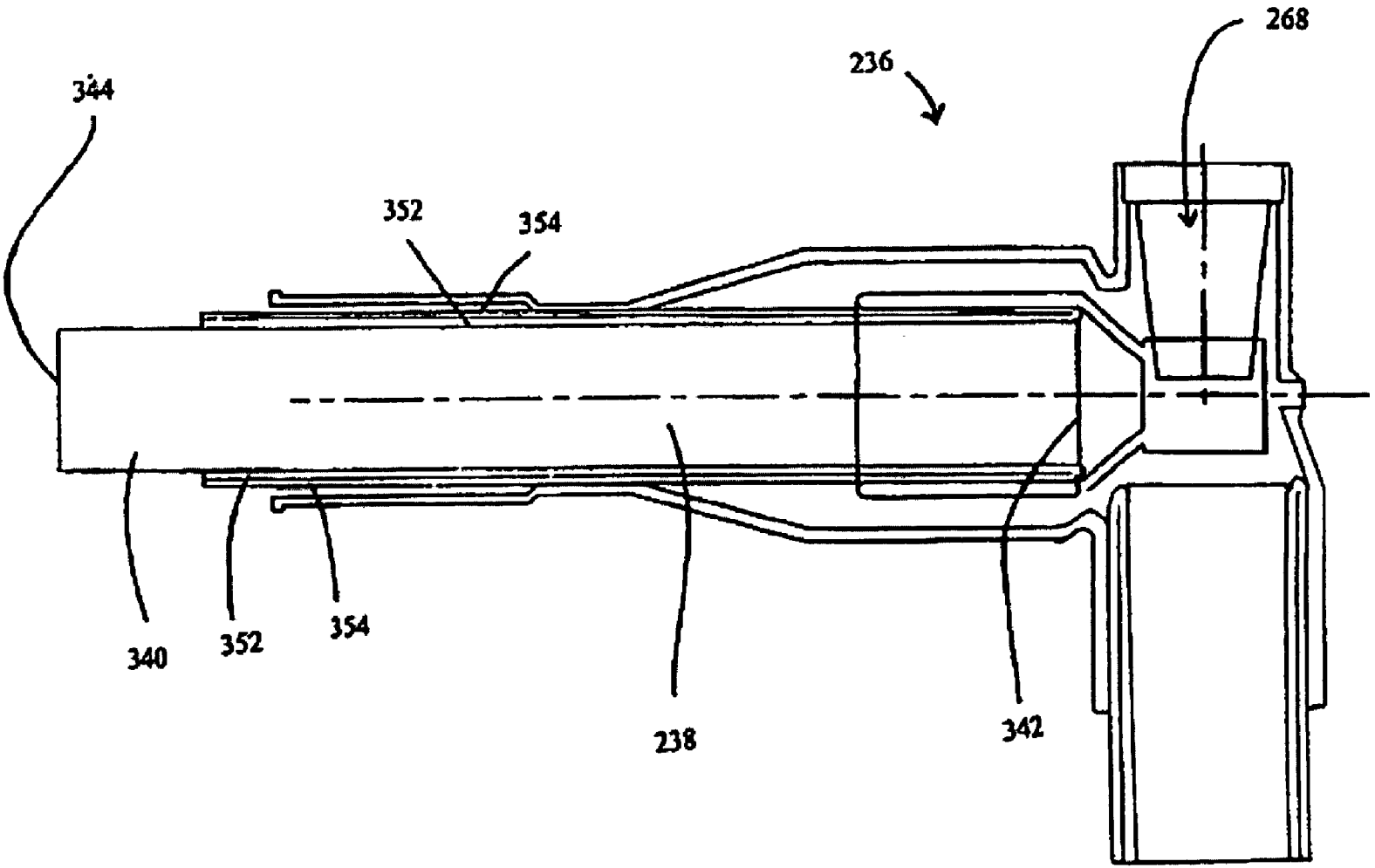
FIG. 9 is a cross sectional view of an elbow housing incorporating a preferred termination system according to the present invention, showing two radially expanded bores each held in its expanded state via respective support cores.

FIGS. 7 and 8 show a preferred embodiment of solid core 340 which comprises a lead end 342, which is the first part of solid core 340 that enters tubular bore 238, and a tail end 344 on the opposite end of solid core 340. Tail end 344 preferably extends beyond the opening of tubular bore 238, thereby providing a portion of solid core 340 that can be grabbed and pulled in order to remove solid core 340 relatively easily. Solid core 340 is preferably covered with a thin film 350, more preferably a thin mylar film.

In a preferred embodiment, thin film 350 can be folded and wrapped around solid core 340, thereby creating two layers of thin film 350, inner layer 352 and outer layer 354, between solid core 340 and tubular bore 238, as shown in FIG. 8. Thin film 350 preferably is attached to solid core 340 at tail end 344. Alternatively, inner layer 352 can be attached to solid core 340 along the outer surface of solid core 340. Preferably thin film 350, when folded, entirely covers the portion of solid core 340 that is within tubular bore 238.

Preferably, the friction coefficient between solid core 340 and thin film 350 is sufficiently low to facilitate the removal of solid core 340 from tubular bore 238. In an embodiment, either one or both solid core 340 and/or thin film 350 is coated with a film having a low friction coefficient, such as silicone, to further reduce the frictional forces.

Referring to FIG. 8, as solid core 340 is slid out of tubular bore 238, tubular bore 238 is released from its radially expanded state from the end furthest inside and finishing at the end nearest the opening of tubular bore 238. Meanwhile, inner layer 352 of thin film 350 slides out of tubular bore 238 with solid core 340. Outer layer 354 remains within tubular bore 238 and folds upon itself as it is being pulled out by inner layer 352. Therefore, when lead end 342 of solid core 340 initially leaves tubular core 238, at least a portion of outer layer 354 remains within tubular bore 238, folded upon itself. Tubular bore 238 can therefore collapse from its expanded state to an intermediate state, wherein a portion is fully collapsed and another portion is partially collapsed, comprising the fold outer layer 354 in between tubular bore 238 and assembly 266. Solid core 340 is preferably pulled even further, thereby entirely removing outer layer 354 from within tubular bore 238.

Referring now to FIG. 4, shown is assembly 266 of prepared cable end 200 for use in connection with the preferred embodiment of the termination system of the present invention. As depicted, preferred prepared cable end 200 is similar to and prepared in a similar manner to prepared cable end 100 of the prior art cable end depicted in FIG. 1A. One difference, however, is that prepared cable end 200 does not require a tape marker 110 (FIG. 1A). As shown, prepared cable end 200 comprises an outer cable jacket 202, shield wires 204, extruded insulation shield 208, cable insulation 212, and cable conductor 214. To create prepared cable end 200, outer cable jacket 202 is removed and shield wires 204 are folded back from extruded insulation shield 208 and folded over cable jacket 202. Extruded insulation shield 208 is also removed to partially expose cable insulation 212. Next, cable insulation 212 is removed to expose cable conductor 214.

Turning to FIG. 4, illustrated is the connection of prepared cable end 200 to metallic lug 220. Preferably, cable conductor 214 of prepared cable end 200 is inserted into a longitudinal bore in metallic lug 220, whereupon metallic lug 220 is crimped onto cable conductor 214 utilizing techniques known in the art. As seen in FIG. 4, the outer diameter of metallic lug 220 is greater than the outer diameter of the cable insulation 212. Prepared cable end 200 is then wiped clean from the end of cable conductor 214 to shield wires 204. Prepared cable end 200 is now prepared for installation of the housing. The cable end is prepared utilizing one of various methods known in the art and utilizes currently accepted lug 220 in an effort to eliminate unnecessary re-training of installers of the preferred embodiment of the termination system of the present invention.

Next, FIG. 5 depicts the insertion of assembly 266 into support core 240 contained within tubular bore 238. At this stage, tubular bore 238 is still held in its radially expanded state by support core 240 such that metallic lug 220 can be easily inserted therein without physical contact with the interior of tubular bore 238. Assembly 266 is inserted into support core 240 and positioned such that aperture 250 of metallic lug 220 is perpendicular to first tapered bore 258 and second tapered bore 268.

Stud 226 is connected to first mating device 228, if first mating device 228 is not already equipped with a stud, and inserted into aperture 250 of metallic lug 2. FIG. 5 shows assembly 266 after it has been inserted into housing 236, along with detached stud 226 and detached first mating device 228. To complete the termination, stud 226 is inserted into first mating device 228 and rotated, typically by hand, until tightly connected to first mating device 228. The interior of housing 236, stud 226, and first mating device 228 are then cleaned and a lubricant is applied. First tapered bore 258 of housing 236 is then positioned over first mating device 228 such that stud 226 is positioned in aperture 250 of metallic lug 220. Then, detached second mating device 230 is cleaned, lubricated, and inserted into second tapered bore 268 of housing 236. After insertion, second mating device 230 is rotated or threaded onto stud 226 until a specified torque is attained, typically 20-60 ft. lbs, depending on the type of mating device. The threading of second mating device 230 to stud 226 creates a proper electrical connection between first mating device 228 and prepared cable end 200 via metallic lug 220. Again, the retention of commonly known termination techniques in conjunction with the preferred embodiment of the termination system of the present invention eliminates the need for re-training of installers.

Once assembly 266 is properly connected within housing 236 as described above, support core 240 can be removed by pulling nylon cord end 242, thereby causing tubular bore 238 to contract, beginning at the interior end of tubular bore 238 and finishing at the exterior end of tubular bore 238.

Once support core is completely removed, as shown in FIG. 6, the conductive insert layer 270 of housing 236 contracts around metallic lug 220, substantially eliminating air surrounding metallic lug 220. In addition, the nonconductive insulating layer 272 of housing 236 contracts around cable insulation 212. Finally, the sealing jacket 276 of housing 236 can contract around cable insulation shield 208, shield wires 204, and outer cable jacket 202, which was previously coated with a sealant, such as a flexible synthetic polymer sealant (e.g., butyl mastic sealant), thereby creating an airtight and waterproof seal. Another possibility is to have sealing jacket 276 rolled up or folded back until the core is removed, whereupon sealing jacket 276 may be folded over shield wires 204 and outer cable jacket 202. This approach allows for a shorter core as well as less distance to remove the core.

As described above, the present invention eliminates the need for a separate cable adapter, and also eliminates the need for a separate sealing jacket. In addition, air gap 134 of the prior art, as depicted in FIG. 1G, is reduced, if not eliminated, thereby reducing the thermal resistance and derating of the termination as discussed above. Although the preferred embodiment of the termination system of the present invention is exemplified herein with reference to a 600 ampere cable, it is understood that the present invention may be used to terminate a cable of any amperage. And in particular, to terminate any cable where the metallic lug has a larger diameter than the insulation cable conductor, an alternative embodiment of the present invention may connect a member other than an electrical cable wherein the member requires a tight seal with the housing. For example, the present invention may be used to connect a pneumatic tube to another pneumatic tube or apparatus, wherein it is desirable to prevent air or moisture from penetrating the connection. A further example includes buried or exposed steel pipelines.

Additionally, the preferred embodiment of the termination system of the present invention uses an elbow, or T-shaped, housing, containing two perpendicular bores. However, it is understood that other housing configurations may be used with the present invention. For example, housings containing more than two bores and/or bores that are not perpendicular may be used. Other housing configurations include, but are not limited to, Y-shaped, L-shaped, and X-shaped housings. The Y-shaped housing is a good example of a housing containing three non-perpendicular bores.

Also, other methods of shrinking the bore of the preferred embodiment of the termination system of the present invention may be used in accordance with the invention. For example, the present invention may be used with bores that are shrunk, or collapsed, via application of heat or chemical solvents as an alternative to removal of a support core.

The core may also take many forms in addition to the nylon cord illustrated above, including a solid, one-piece tubular core or a core that is mechanically weakened. Furthermore, whereas the core of the preferred embodiment of the present invention is located internal to the bore, the core can also be located external to the bore.

While the present invention has been described with reference to one or more embodiments set forth in considerable detail for the purposes of making a complete disclosure of the invention, such embodiments are merely exemplary, and are not intended to limit or represent an exhaustive enumeration of all aspects of the invention. The scope of the invention, therefore, shall be defined solely by the following claims. Further, it will be apparent to those of skill in the art that numerous changes may be made in such details without departing from the spirit and the principles of the invention.

I claim:

1. An apparatus for connecting two or more members, said apparatus comprising:

a housing comprising at least a first bore and a second bore arranged at a positive angle to each other, the housing substantially formed of a thermoset material;

wherein said first bore comprises a retaining device for holding at least a portion of said first bore in a radially expanded state;

a first member inserted into said first bore; and a second member inserted into said second bore;

wherein removing said retaining device from said first bore causes at least a position of said first bore to contract around said first member without heating the first bore.

2. The apparatus according to claim 1, further comprising:

a connection device inserted into said second bore for connecting said first member to said second member.

3. The apparatus according to claim 1, wherein said second bore comprises:

a second retaining device for holding at least a portion of said second bore in a radially expanded state;

wherein removing said second retaining device from said second bore causes said second bore to contract around said second member.

4. The apparatus according to claim 1, wherein at least one of said first member and said second member comprises a plurality of members coupled together.

5. The apparatus according to claim 1, wherein at least one of said first member and said second member comprises an electrical cable.

6. The apparatus according to claim 1, wherein said first member comprises an electrical cable coupled to a metallic lug.

7. The apparatus according to claim 6, wherein said metallic lug has a larger outside diameter than said electrical cable insulation.

8. The apparatus according to claim 1, wherein said second member comprises a mating device.

9. The apparatus according to claim 1, wherein said second member comprises an electrical cable coupled to a mating device.

10. The apparatus according to claim 1, wherein said housing is fabricated of Ethylene Propylene Diene Monomer ("EPDM").

11. The apparatus according to claim 1, wherein said housing comprises a "T" configuration or a 600 ampere class elbow connector.

12. The apparatus according to claim 1, wherein a diameter of said first bore is radially expanded.

13. The apparatus according to claim 1, wherein said retaining device comprises a core.

14. The apparatus according to claim 1, wherein said retaining device comprises nylon.

15. The apparatus according to claim 1, wherein said retaining device comprises polyvinylchloride.

16. The apparatus according to claim 1, wherein said retaining device comprises polycarbonate.

17. The apparatus according to claim 1, wherein said retaining device comprises polypropylene cord wound in a cylindrical configuration; and wherein each radial section of said polypropylene cord is coupled to an adjacent radial section of said polypropylene cord for retaining said cylindrical configuration.

18. The apparatus according to claim 1, wherein said retaining device comprising a reinforcement structure.

19. The apparatus according to claim 18, wherein said reinforcement structure comprises a ring-like structure.

20. The apparatus according to claim 1, wherein said retaining device is coupled to an interior of said first bore.

21. The apparatus according to claim 1, wherein said retaining device is coupled to an exterior of said first bore.

22. The apparatus according to claim 1, wherein said first bore is cylindrical.

23. The apparatus according to claim 1, wherein said first bore comprises a tube having a varying diameter along its length.

24. The apparatus according to claim 2, wherein said second bore is tapered.

25. The apparatus according to claim 2, wherein said connection device is a threaded mating device.

* * * * *